US008469247B2

(12) United States Patent
Nicoletti

(10) Patent No.: US 8,469,247 B2
(45) Date of Patent: Jun. 25, 2013

(54) GAS TANK HOLDER SYSTEM

(76) Inventor: William L Nicoletti, Derby, CT (US)

( * ) Notice: Subject to any disclaimer, the term of this patent is extended or adjusted under 35 U.S.C. 154(b) by 268 days.

(21) Appl. No.: 12/960,741

(22) Filed: Dec. 6, 2010

(65) Prior Publication Data

US 2012/0138645 A1 Jun. 7, 2012

(51) Int. Cl.
*B65D 25/10* (2006.01)

(52) U.S. Cl.
USPC ..... 224/403; 224/502; 224/548; 224/549

(58) Field of Classification Search
USPC ..... 224/403, 502, 548, 549, 553; 128/205.22; 405/185–187; 248/309.1, 311.2, 312, 312.1, 248/456; 403/61
See application file for complete search history.

(56) References Cited

U.S. PATENT DOCUMENTS

| | | | | |
|---|---|---|---|---|
| 3,547,391 | A | 12/1970 | Johnson | |
| 3,603,550 | A | 9/1971 | Byrd | |
| 3,737,133 | A | 6/1973 | Boecker | |
| 3,780,972 | A | 12/1973 | Brodersen | |
| 4,023,761 | A | 5/1977 | Molis | |
| 4,304,383 | A | 12/1981 | Huston | |
| 4,586,687 | A | 5/1986 | Ziaylek, Jr. | |
| D324,220 | S * | 2/1992 | Evans et al. | D14/253 |
| 5,354,029 | A | 10/1994 | Ziaylek, Jr. et al. | |
| 5,362,022 | A | 11/1994 | McLoughlin et al. | |
| 5,533,701 | A | 7/1996 | Trank | |
| 6,086,312 | A | 7/2000 | Ziaylek et al. | |
| 6,220,557 | B1 | 4/2001 | Ziaylek et al. | |
| 6,702,242 | B1 | 3/2004 | Ziaylek, Jr. et al. | |
| D494,049 | S | 8/2004 | Ziaylek et al. | |
| 6,883,766 | B1 | 4/2005 | Ziaylek et al. | |
| 6,926,243 | B1 | 8/2005 | Ziaylek et al. | |
| 2008/0042028 | A1 * | 2/2008 | Ross et al. | 248/230.1 |
| 2008/0078911 | A1 | 4/2008 | Ziaylek | |

* cited by examiner

*Primary Examiner* — Adam Waggenspack
(74) *Attorney, Agent, or Firm* — Bachman & LaPointe, P.C.

(57) ABSTRACT

An apparatus for holding a gas tank includes a bottom element which is mounted to a supporting surface and a cover element pivotally mounted to the cradle. The cover element has at least one device for holding a gas tank. The apparatus further includes a system for rotating the cover element relative to the bottom element so as to raise the gas tank from a storage position to a substantially vertical operational position so that an individual can don the gas tank. In a preferred embodiment, the rotating system includes an L-shaped track attached to the bottom element, a raised portion with an aperture attached to the cover element, and a guide rod which has a first end in the aperture and a second end which engages with and slides in the L-shaped track.

16 Claims, 4 Drawing Sheets

GAS TANK HOLDER SYSTEM

BACKGROUND (1) Field of the Invention

The present invention relates to a system for a holding a gas tank such as a firefighter's or rescue worker's air tank.

(2) Prior Art

It is standard procedure to outfit a firefighter or other rescue worker with a breathing apparatus allowing him/her to breathe normally in a smoke-filled building. A typical breathing apparatus consists of a cylindrical air tank or bottle coupled to a face mask, which the firefighter or rescue worker places over his nose and eyes when needed. Shoulder straps, and sometimes a waist harness are provided on the tank so that the apparatus may be conveniently carried on the firefighter's or rescue worker's back.

When not in use, the breathing apparatus is often stored in a bracket permanently mounted on a fire truck. The simplest type of bracket consists of a pair of C-shaped clips extending from an elongated backplate, with a footplate extending from the lower end of the backplate to support the neck of the air tank. To don the apparatus, the firefighter or rescue worker places his back against the air tank and pulls the shoulder straps, which normally hang limply from the tank, over his shoulders. This is a rather difficult procedure, especially when the firefighter is clothed in several layers of heavy, protective clothing, and it can result in a loss of valuable time. One such air tank bracket system employing C-shaped clips is shown in U.S. Pat. No. 5,362,022 to McLoughlin et al. Still other systems which employs C-shaped clips are shown in U.S. Pat. No. 5,354,029 to Ziaylek, Jr. et al., U.S. Pat. No. 6,220,557 to Ziaylek et al., and U.S. Pat. No. 3,780,972 to Brodersen.

U.S. Pat. No. 6,702,242 to Ziaylek, Jr. et al. illustrates a releasable tank holding assembly securable to a hollow seat back to facilitate the detachable securement of a tank thereinto. In this assembly, a housing is included with a tank receiving recess positionable in a hollow seat back area. The housing is made of a flexibly resilient plastic material for protection of the tank but includes a retaining bracket, preferably of metal, secured to the rear portion for strengthening and securement to a seat back.

U.S. Design Pat. No. D494,049 to Ziaylek et al. and U.S. Pat. No. 6,926,243 to Ziaylek et al. illustrate a mounting bracket with ejection mechanism for holding a cylindrical tank.

A pivotable tank handling apparatus is illustrated in U.S. Pat. No. 6,086,312 to Ziaylek. The handling apparatus is capable of securely locking the tank in place at the storage or usage position while allowing it to be detached therefrom and transferred to a tank service position for removal and replacement or servicing. The apparatus includes a locking mechanism including a locking hook construction and a locking housing with a locking slide movable mounted therein wherein a locking handle is secured thereto for movement of the locking slide between the position of engagement and the position of release of the locking hook.

Quick release systems for supporting an air tank having pivotable C-shaped arms is shown in U.S. Pat. Nos. 4,586,687 to Ziaylek; 6,883,766 to Ziaylek et al.; and 3,603,550 to Byrd.

U.S. Patent Publication No. 2008/0078911 to Ziaylek illustrates a bracket for holding cylindrical tanks adjacent to a wall surface or behind a seat surface in a detachable manner. An upper and lower securement strap are secured together at an engaging tab, which straps extend around the tank when the tab is engaged and can be easily released for rapid exit. A webbing extends between the upper and lower securement straps.

U.S. Pat. No. 3,547,391 to Johnson relates to a quick release support for the oxygen tank of a breathing apparatus suitable for attachment to the seat of a fire engine or other rescue vehicle. Upon arrival at the scene, the occupant presses a lever which permits the tank and its associated breathing apparatus to be withdrawn from the supporting arms as the occupant dismounts from the seat.

U.S. Pat. No. 3,737,133 to Boecker illustrates a quick-release article holder for mounting on a vertical surface and having a bifurcated lower support member and a spaced upper clamping member which is pivotally mounted for rotative movement into or out of engagement with the upper portion of the article to be held. The holder is particularly adapted for use in retaining cylindrical breathing apparatus which is mounted on the wall of a fire station or on a panel of a mobile fire apparatus and serves to retain and support the breathing apparatus when it is not in use or while it is being harnessed to the back of a user. A lever-operated linkage serves to pivot the upper retaining member out of clamping engagement with the apparatus so that the entire breathing apparatus can be moved horizontally away from the holder by the action of the user walking away from the holder after the breathing apparatus has been harnessed to his back.

U.S. Pat. No. 4,023,761 illustrates an adjustable bracket used to stabilize upright compressed gas containers against displacement on mobile vehicles and ship-board installations and maintenance shops. A pair of braces adjustably mounted on a rigidly supported container-encircling plastic collar and movable into firm engagement with diametrically opposite portions of the periphery of an encircled gas-filled container are provided.

U.S. Pat. No. 5,533,701 to Trank illustrates a c-shaped bracket for stabilizing a cylindrical compressed air tank against a bulkhead of a boat. The C-shaped bracket has a first position in which it extends from the bulkhead and a second position in which it folds against the bulkhead.

Still another bracket for holding a tank is shown in U.S. Pat. No. 4,304,383 to Huston. In one embodiment, a pair of straps and a shim are detachably affixed to the body of the bracket by tabs so that the entire unit is initially of one piece construction.

Despite these systems, there remains a need for a system which enables a firefighter or a rescue worker to quickly get into the air breathing apparatus.

SUMMARY OF THE INVENTION

In accordance with the present invention, there is provided a gas tank holding apparatus which allows a user to quickly don a gas tank.

In accordance with the present invention, the gas tank holding apparatus broadly comprises a bottom element which is mounted to a supporting surface; a cover element pivotally mounted to said cradle; said cover element having means for holding a gas tank; and means for rotating said cover element relative to said bottom element so as to raise said gas tank from a storage position to a substantially vertical operational position so that an individual can don said gas tank.

Other details of the gas holding apparatus of the present invention are set forth in the following detailed description and the accompanying drawings in which like reference numerals depict like elements.

DETAILED DESCRIPTION OF THE PREFERRED EMBODIMENT(S)

Figure 1:
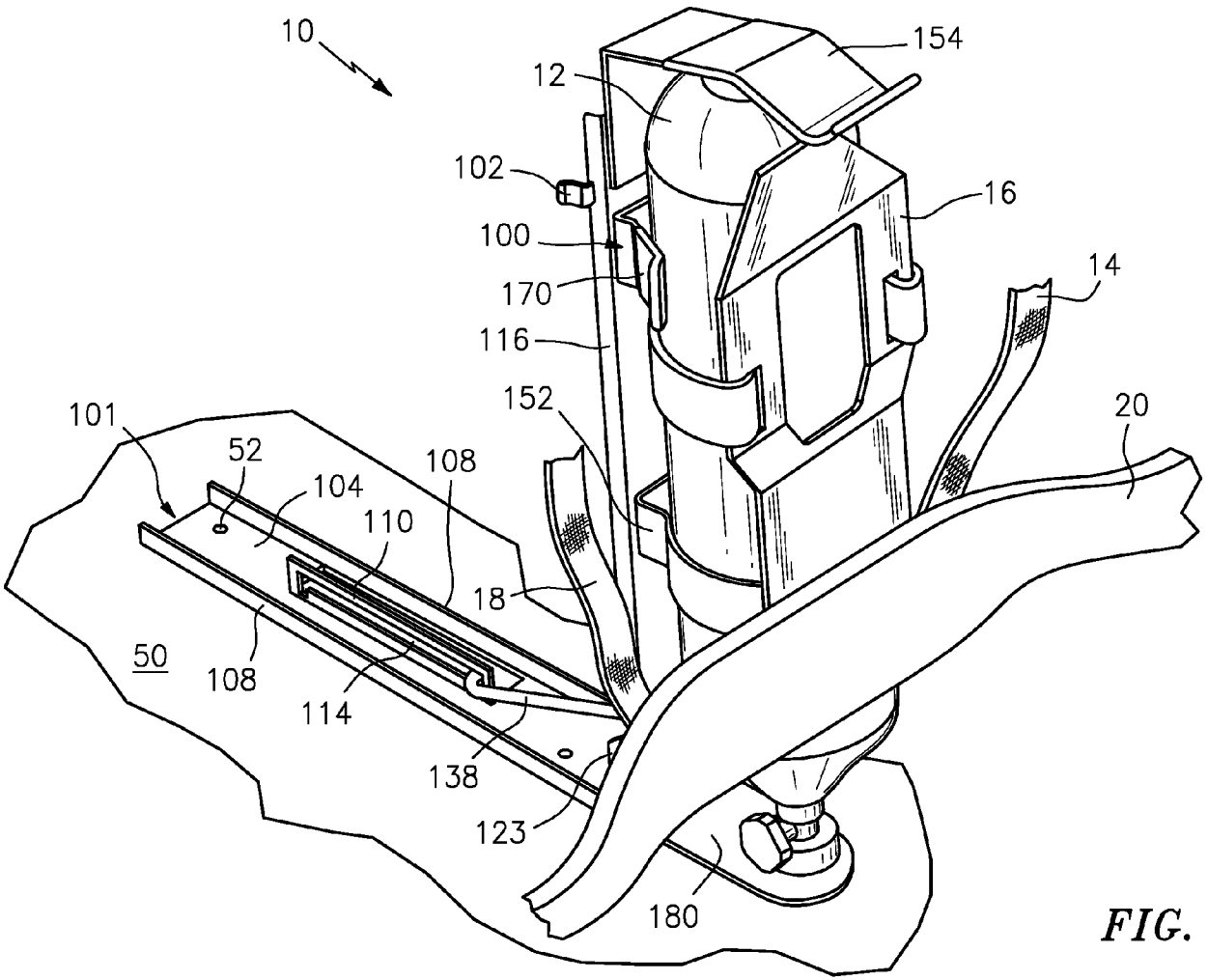
FIG. 1 is a schematic representation of a gas tank holding apparatus in accordance with the present invention.
Figure 2:
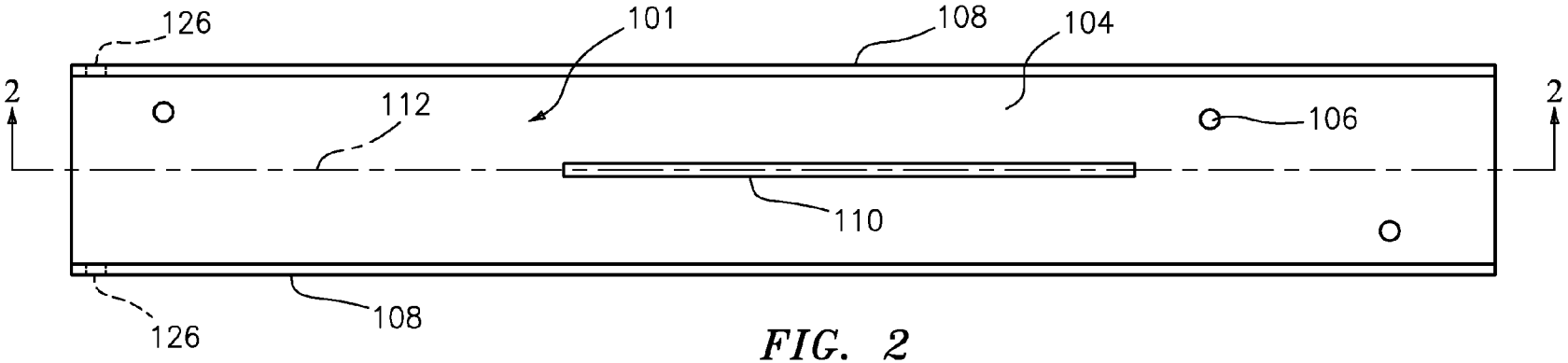
FIG. 2 illustrates a top view of a bottom element of the holding apparatus of FIG. 1.
Figure 3:
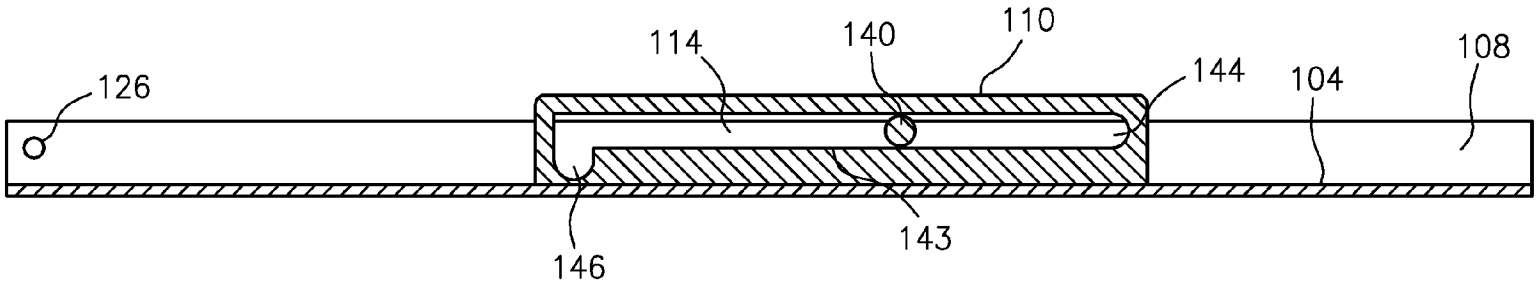
FIG. 3 is a sectional view of the bottom element of FIG. 2.

In accordance with the present invention, as shown in FIGS. 1-12, there is provided an apparatus 10 for holding a cylindrical gas 12 tank, such as a tank containing breathing air, to be worn by an individual such as a firefighter or a rescue worker. As shown in FIG. 1, the tank may have attached to it a harness 14 to be worn by the individual. The harness may include a back plate 16, straps 18, and a waist belt 20.

Figure 4:
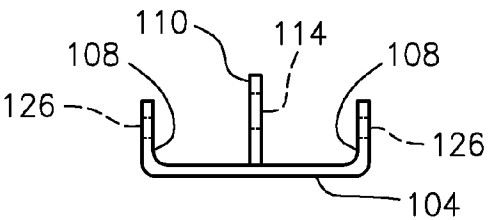
FIG. 4 is an end view of the bottom element of FIG. 2.

The apparatus 10 includes a cradle 100 for supporting the tank 12. As shown in the Figures, the cradle 100 is pivotally attached to a bottom element 101 which may be mounted to a supporting surface 50 of a vehicle (not shown), such as a floor panel of a cargo compartment or a floor of a storage compartment, or any other surface. The bottom element 101 has a central web 104 having one or more holes 106 through which a fastener 52 can be inserted for mounting the bottom element 101 to the surface 50. The bottom element 101 has two spaced apart side rails 108 with each of the side rails 108 being positioned on a side of the web 104. In a preferred embodiment, the web 104 and the side rails 108 are a unitary structure having a substantially U-shaped cross section as shown in FIG. 4. The web 104 and the side rails 108 may be formed from any suitable material known in the art. Preferably, they are formed from a metal such as steel.

The web 104 is provided with a vertical structure 110, preferably located along its central longitudinal axis 112. The vertical structure 110 is preferably formed from a metal, such as steel, and is preferably formed as a unitary structure with the web 104. The vertical structure 110 has an L-shaped track 114 for receiving an end portion 140 of a guide rod 138 which is attached to a cover element 116 which in a retracted or closed position may fit over the bottom element 101. The cover element 116 may be provided with clips 102 on opposite sides of the cover element 116. The clips 102 frictionally engage the side rails 108 to hold the cover element 116 in the retracted or closed position.

Figure 5:
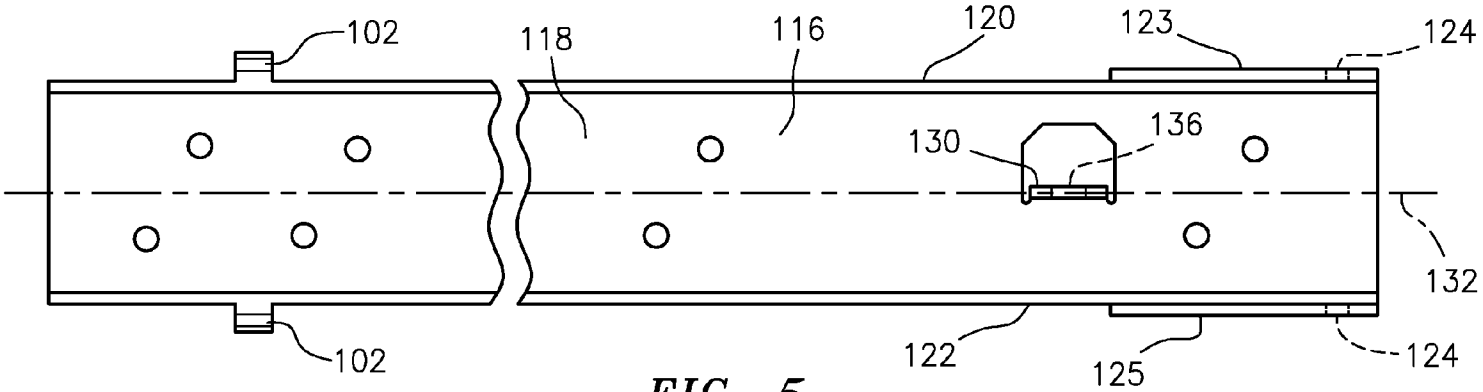
FIG. 5 is a bottom view of a cover element used in the holding apparatus of FIG. 1.
Figure 6:
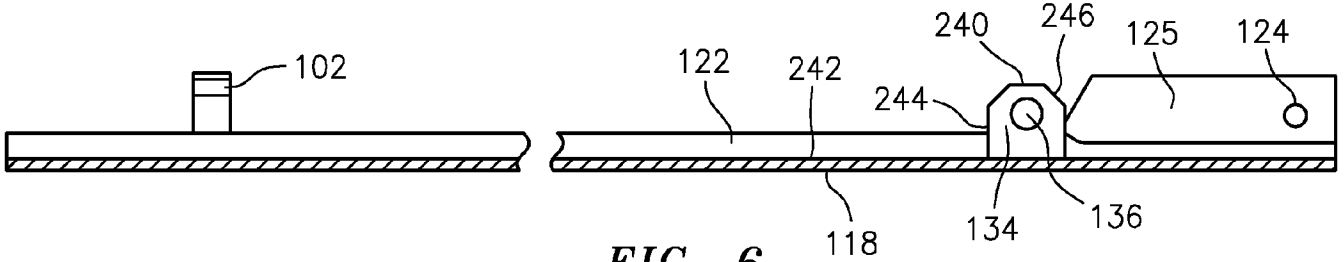
FIG. 6 is a sectional view of the cover element of FIG. 5.
Figure 7:
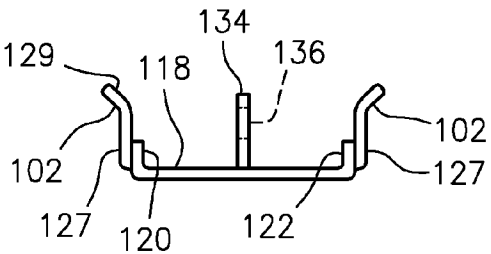
FIG. 7 is an end view of the cover element of FIG. 5.

The cradle 100 is formed by a cover element 116 which as shown in FIGS. 5-7, has a substantially U-shaped configuration and is sized to fit over the bottom element 101. The cover element 116 has a central web portion 118 and two side rails 120 and 122. The central web portion 118 and the side rails 120 and 122 form a unitary structure. While the cover element 116 may be formed from any suitable material known in the art, it is preferably formed from a metal such as steel. The cover element 116 is pivotally attached to the bottom element 101 so that the cover element 116 may rotate relative to the bottom element 101 from a retracted position where the cover element 116 overlaps the bottom element 101 to an operational position where the cover element 116 is at an angle with respect to the bottom element 101. Pivotal or rotational movement of the cover element 116 may be accomplished by providing a pair of side elements 123 and 125 attached to or integrally formed with respective ones of the side rails 120 and 122. The side elements 123 and 125 overlap respective portions of the rails 108 when the cover element 116 is in the retracted or closed position. Each of the side elements 123 and 125 has an aperture 124 which aligns with a respective one of a pair of apertures 126 in the side rails 108. Any suitable pin connection known in the art may be used to allow pivotal/rotational movement of the cover element 116 to the bottom element 101. For example, the pin connection may be a pin (not shown) having a head at one end and a threaded portion at an opposite end. The pin may pass through the aligned apertures 124 and 126 so that the head abuts one of the side elements 123, 125. A nut (not shown) may be placed into threaded engagement with the threaded end of the pin and tightened so that it abuts the other of the side elements 123, 125. If desired, the pin connection may consist of more than one pin element which in combination allow the desired rotation.

Referring now to FIG. 7, each of the clips 102 preferably has a first portion 127 extending upwardly from the respective side rail 120, 122 and a second portion 129 angled with respect to the first portion. The first portions 127 are configured so as to fit over the side rails 108 of the bottom element 101. The second portion 129 allows one to grab the clip 102 so that the cover element 116 can be moved relative to the bottom element 101.

The web 118 has a central pivot mechanism 130, preferably located along its central longitudinal axis 132. The central pivot mechanism 130 consists of a raised portion 134 having an aperture 136 for receiving an end of a guide rod 138. The raised portion 134 may have any desired shape. As shown in FIG. 6, the raised portion 134 may have a central or top portion 240 which is parallel to a surface 242 of the web 118, two portions 244 which are perpendicular to the surface 242, and two angled portions 246 which connect the central portion 240 to the perpendicular portions 244. The raised portion 134 may be formed from any suitable material known in the art. In a preferred embodiment, the raised portion 134 is formed from the same material as the cover element 116. Further, in a preferred embodiment, the raised portion 134 is formed as a unitary structure with the cover element 116. One end 142 of the guide rod is positioned in the aperture 136. It may be held in place by a washer (not shown) which is placed against one side of the raised portion 134 and a removable pin (not shown) which passes through the slot 141.

Figure 8:
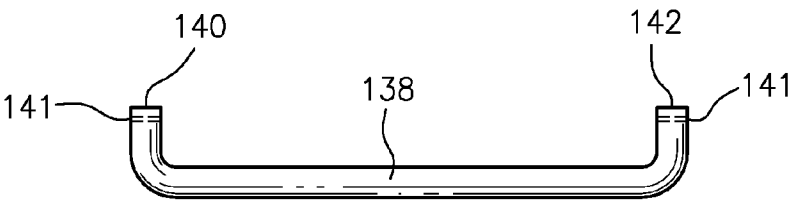
FIG. 8 is a top view of a guide rod used in the holding apparatus of FIG. 1.

Referring now to FIG. 8, there is shown the guide rod 138. The guide rod 138 preferably has a U-shaped configuration with opposed end portions 140 and 142. As discussed above, the end portion 140 is positioned within the track 114 and slides within the L-shaped track 114. The end portion 140 is held in place for operation in the track 114 by a washer (not shown) which abuts one side of the track 114 and a pin (not shown) which passes through the slot 141 in the end 140. As discussed above, the end portion 142 is fixedly located within the aperture 136. When the cover element 116 is located in a position parallel to the surface 102, the end portion 140 is located in the end portion 144 of the track 114. As the cover element 116 is rotated relative to the bottom element 101, the end portion 140 slides along the surface 143 of track 114. When the cover element 116 reaches its full open, operational position, the end portion 140 reaches the end portion 146 of the track portion 142 and is seated therein. In its full open, operational position, the cover element 116 may be substantially perpendicular to the surface 242. By providing the track portion 146, the guide rod 138 is put into a position where the cover element 116 is locked into the upright angled position. This allows the individual to easily access and don the gas tank 12 which is attached to the cover element 116. To close the cover element 116, the end 140 of the pin 138 may be lifted out of the track portion 146 so that it can slide along the surface 143 of the track 114.

Figure 9:
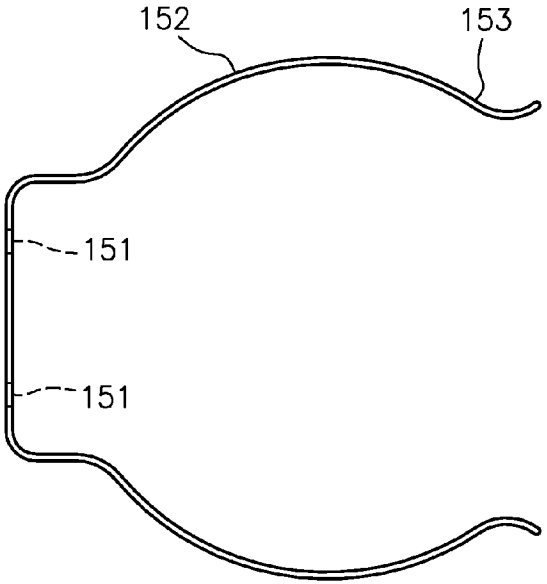
FIG. 9 is a top view of a substantially C-shaped clamp used in the holding apparatus of FIG. 1.

The gas tank 12 may be attached or secured to the cover element 116 by one or more substantially C-shaped clamps 152 shown in FIG. 9. If one substantially C-shaped clamp 152 is used, it may be located substantially in the center of the cover element 116. The substantially C-shaped clamp(s) 152 may be secured to the cover element 116 using any suitable fastening means known in the art. For example, each C-shaped clamp 152 may be welded to the cover element 116. Alternatively, each C-shaped clamp 152 may be removably secured to the cover element 116 by a bolt and nut connection. To this end, apertures 151 may be provided in the clamp 152 to allow a bolt to pass therethrough. The C-shaped clamp 152 may be formed from any suitable material known in the art such as a metallic material. If desired, end portions 153 of the clamp 152 may be coated to prevent scratching of the exterior surface of the gas tank 12.

Figure 10:
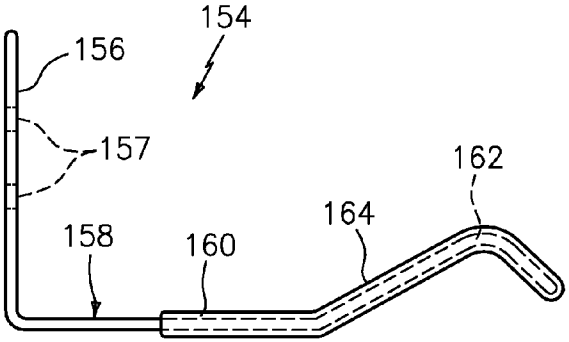
FIG. 10 is a side view of a seat element used in the holding apparatus of FIG. 1.

The cover element 116 may also be provided with a seat element 154 upon which an end of the gas tank 12 may rest. The seat element 154 may be formed from any suitable material known in the art, such as a metallic material, and may be secured to the cover element 116 using any suitable means known in the art. For example, if desired, the seat element 154 may be welded to the cover element. Alternatively, the seat element 154 may be removably secured to the cover element 116 by one or more bolt and nut connections. To this end, a back portion 156 of the seat element 154 may be provided with one or more slots 157 for allowing a bolt to pass therethrough. The slots 157 may have a length which is just slightly less than the length of the back portion. This allows the seat element 154 to be adjustable relative to the cover element so that tanks of various sizes may be accommodated. The seat element 154 may have any desired shape. For example, as shown in FIG. 10, it may have the back portion 156 and an integrally formed base portion 158 at a right angle to the back portion 156. The base portion 158 may have a flat section 160 and angled section 162 for holding the gas tank 150 in place. If desired, a portion of the flat section 160 and the angled section 162 may have a coating 164, such as a PLASTISOL dip coating, to prevent damage to the gas tank.

Figure 11:
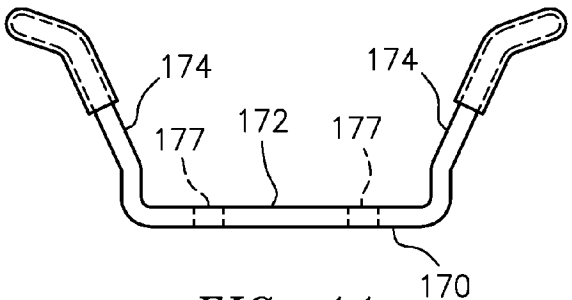
FIG. 11 is a side view of a clip used in the holding apparatus of FIG. 1.

Referring now to FIG. 11, there is shown a clamp 170 having a central portion 172 and outwardly extending side arms 174. Portions of the side arms 174 may be coated to prevent damage to the gas tank. The coating 176 on the side arms 174 may be any suitable coating known in the art such as a PLASTISOL dip coating. Preferably, the clamp 170 is attached to the cover element 116 in a position intermediate the clamp 152 and the seat element 154. The clamp 170 may be attached to the cover element 116 using any suitable means known in the art. For example, the clamp 170 could be welded to the cover element 116. Alternatively, the clamp 170 could be removably secured to the cover element by one or more bolt and nut connections. To this end, the clamp 170 may be provided with one or more apertures 177 for receiving the bolt(s). The clamp 170 may be formed from any suitable material known in the art such as a spring steel material.

Figure 12:
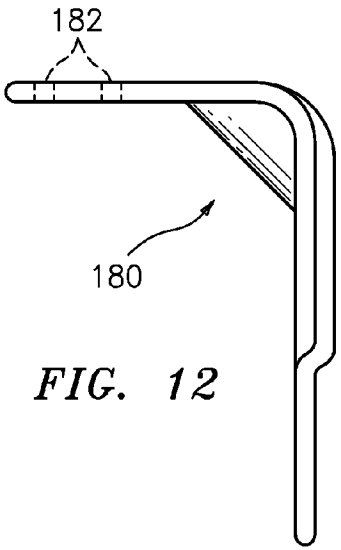
FIG. 12 is a side view of a footing used in the holding apparatus of FIG. 1.

Referring now to FIG. 12, there is shown an L-shaped footing 180 which is attached to the cover element 116 at an end opposed to the end where the seat element 154 is located. The footing 180 protects an end of the gas tank 12. The footing 180 may be secured to the cover element using any suitable means known in the art. For example, it may be welded to the cover element. Alternatively, the footing 180 may be joined to the cover element by one or more bolt and nut connections (not shown). To this end, apertures 182 may be provided in the footing 180 to allow one or more bolts to pass therethrough. The footing 180 may be formed from any suitable material known in the art. For example, it may be formed from a metallic material.

As can be seen from the foregoing discussion, the apparatus 10 allows a gas tank to be securely held in a stored position where the cover element 116 is not at an angle with respect to the base element 101 and then raised into an operational position as shown in FIG. 1 where the cover element 116 is at an angle with respect to the base element 101.

While the apparatus 10 has been described as being manually operated, it should be apparent that a motorized assist device may be incorporated into the apparatus 10 to further assist in deployment of the cover element 116 relative to the base element 101.

While metal materials are the preferred materials for forming the components of the apparatus 10, it should be recognized that other materials such as wood and/or plastic may be used for one or more of the components.

While the present invention has been described in the context of an apparatus for holding a cylindrical gas tank used by firefighters or rescue workers, the apparatus of the present invention may be used to hold other types of cylindrical tanks, such as scuba diving tanks aboard ships or boats.

There has been provided in accordance with the present invention a gas tank holding apparatus which fully satisfies the objects, means, and advantages set forth hereinbefore. While the present invention has been described in the context of specific embodiments thereof, other unforeseeable alternatives, modifications, and variations may become apparent to those skilled in the art having read the foregoing description. It is intended to embrace those alternatives, modifications, and variations as fall within the broad scope of the appended claims.

What is claimed is:

1. A gas tank holding apparatus comprising:

a bottom element which is adapted to be mounted to a supporting surface;

said bottom element having a central web and two side rails and a substantially U-shaped cross sectional shape;

said bottom element further having a structure extending upwards from said central web;

a cover element pivotally mounted to said bottom element;

said cover element having at least one means for holding a gas tank; and means for rotating said cover element relative to said bottom element so as to raise said gas tank from a storage position to a substantially vertical operational position, wherein said rotating means comprises an L-shaped track incorporated within said structure extending upwards from said central web, a raised portion incorporated into said cover element, and a guide rod having a first end which fits into an aperture in said raised portion and a second end which cooperates with a slide surface of said track.

2. The gas tank holding apparatus of claim 1, wherein said supporting surface comprises a surface of a vehicle and said apparatus further comprises means for mounting said bottom element to said surface of said vehicle.

3. The gas tank holding apparatus of claim 2, wherein said surface is a floor of a storage compartment in said vehicle.

4. The gas tank holding apparatus according to claim 1, wherein said cover element has a central web and said raised portion is perpendicular to said central web.

5. The gas tank holding apparatus of claim 1, wherein said cover element has a central web and two side rails and a substantially U-shaped cross sectional shape.

6. The gas tank holding apparatus according to claim 5, wherein each side rail of said bottom element has an aperture and each side rail of said cover element has an aperture which aligns with a respective aperture in a respective one of said bottom element side rails.

7. The gas tank holding apparatus according to claim 6, further comprising at least one pin connection for connecting said bottom element to said cover element so that said cover element can rotate relative to said bottom element.

8. The gas tank holding apparatus according to claim 1, wherein said at least one means for holding a gas tank comprises a substantially C-shaped clip located in the middle of said cover element.

9. The gas tank holding apparatus according to claim 8, wherein said at least one means for holding a gas tank further comprises a clamp having a central portion and outwardly extending side arms and wherein said clamp is located intermediate said substantially C-shaped clip and an end of said cover element.

10. The gas tank holding apparatus according to claim 1, further comprising a seat element attached to a first end of said cover element and an L-shaped footing attached to a second end of said cover element opposed to said first end.

11. The gas tank holding apparatus according to claim 10, wherein said seat element has a back portion and a base portion with a flat section and an angled section and said back portion has a plurality of slots for allowing the seat element to be adjustable relative to the cover element.

12. The gas tank holding apparatus of claim 1, wherein said cover element is movable between a retracted position where said cover element overlaps said bottom element and an operational position where said cover element is at an angle with respect to said bottom element.

13. The gas tank holding apparatus of claim 12, wherein said cover element has a pair of clips for contacting said bottom element when said cover element is in said retracted position.

14. A gas tank holding apparatus comprising:

a bottom element which is adapted to be mounted to a supporting surface;

a cover element pivotally mounted to said bottom element;

said cover element having at least one means for holding a gas tank;

means for rotating said cover element relative to said bottom element so as to raise sad gas tank from a storage position to a substantially vertical operational position;

said rotating means comprising an L-shaped tack incorporated into said bottom element, a raised portion incorporated into said cover element, and a guide rod having a first end which fits into an aperture in said raised portion and a second end which cooperates with a slide surface of said track, wherein said guide rod has a C-shape.

15. The gas tank holding apparatus according to claim 14, wherein said bottom element has a central web and a vertical structure extending from said central web and said L-shaped track is located in said vertical structure.

16. The gas tank holding apparatus of claim 14, wherein said bottom element has a central web and two side rails and a substantially U-shaped cross sectional shape.

* * * * *